United States Patent [19]

Easterling et al.

[11] 4,016,936

[45] Apr. 12, 1977

[54] MOTOR GRADER HAVING IMPROVED GUIDE SHOES FOR CIRCLE-MOUNTED IMPLEMENT

[75] Inventors: Gene B. Easterling, Decatur, Ill.; Joseph L. Strabala, Orinda, Calif.

[73] Assignee: Caterpillar Tractor Co., Peoria, Ill.

[22] Filed: Apr. 24, 1975

[21] Appl. No.: 571,118

[52] U.S. Cl. ..... 172/796; 91/461; 172/793

[51] Int. Cl.[2] ..... E02F 3/76

[58] Field of Search ..... 172/4.5, 792, 793, 795, 172/796, 797, 734, 741, 742; 91/6, 433, 461

[56] References Cited

UNITED STATES PATENTS

| | | | |
|---|---|---|---|
| 1,841,403 | 1/1932 | Dean | 172/796 |
| 2,034,141 | 3/1936 | Gustafson | 172/793 X |
| 2,189,344 | 2/1940 | Gustafson | 172/793 |
| 2,247,464 | 7/1941 | Arndt | 172/793 |
| 2,258,890 | 10/1941 | Gustafson | 172/793 |
| 2,278,806 | 4/1942 | Tilton | 172/792 |
| 2,961,783 | 11/1960 | Bowen et al. | 172/4.5 |
| 3,060,688 | 10/1962 | Gondek | 91/433 |
| 3,220,318 | 11/1965 | McGuire | 91/461 |
| 3,593,806 | 7/1971 | Gurries | 172/741 |

*Primary Examiner*—Richard T. Stouffer
*Attorney, Agent, or Firm*—Phillips, Moore, Weissenberger, Lempio & Majestic

[57] ABSTRACT

A motor grader including a wheeled main frame and a drawbar structure attached thereto is disclosed wherein a circle-mounted working implement, such as a blade or the like, is supported on the drawbar by improved guide shoes. The improved guide shoes include surfaces in engagement with both upper and lower surfaces of the circle at all times and remotely controlled mechanical apparatus for varying the frictional forces exerted by such guide shoes on the circle, whereby undesirable effects due to wearing of the engaging surfaces in operation are reduced.

10 Claims, 4 Drawing Figures

MOTOR GRADER HAVING IMPROVED GUIDE SHOES FOR CIRCLE-MOUNTED IMPLEMENT

BACKGROUND OF THE INVENTION

This invention relates to motor graders in which a circle-mounted working implement, such as a blade or the like, is supported by means of guide shoes on a drawbar structure attached to the main frame of the motor grader and more particularly to such a motor grader including improved guide shoes which reduce the undesirable effects due to wearing of mating surfaces of the circle and drawbar structure in operation.

It will be understood that during grading operations it is often necessary to adjust the angle of the blade or other working implement of a motor grader with respect to the direction of travel of the motor grader. In the case of a blade such adjustment will depend upon the width of the strip of surface to be graded and upon the amount of material picked up by the blade at a particular point in the grading operation. Thus, the operator of the motor grader may make adjustments in the angle of the blade with respect to the direction of travel of the motor grader by rotating the circle upon which the blade is mounted about its axis. Structures of the prior art, usually including guide shoes, by which the circle-mounted working implement was supported on the drawbar of the motor grader, have seriously reduced the accuracy and smoothness of the graded surface which could be produced due to the working clearances and tolerances required in such supporting structure as well as the normally expected wear on the mating surfaces of the supporting structure.

It will be understood that the vertical positioning of a blade with respect to the surface to be graded is established by one control means of the motor grader and that any change in such vertical positioning due to the operation of further control means for adjusting the angle of the blade with respect to the direction of travel of the motor grader will reduce the smoothness and accuracy of the resulting grade surface. Modern motor graders use an automatic blade control (A. B. C.) device for reading the desired grade level from a reference grade line or wire and automatically adjusting the vertical positioning of the blade to maintain the reference level. However, such devices cannot compensate for changes in the vertical positioning of the blade which will result from any lost motion present in the supporting structure for the blade. In motor graders of the prior art, an attempt was made to hold working clearances and tolerances to a minimum, however, such working clearances and tolerances were subject to radical change in operation due to wearing of mating surfaces of such structures. Since tolerances as small as ⅛ inch are now required in road grading operations, it will be seen that any appreciable lost motion in the supporting structure due to wear and working tolerances will increase the difficulty of maintaining the required grade tolerance.

SUMMARY OF THE INVENTION

A motor grader including this invention comprises a main frame mounted on wheels, a drawbar structure attached to the main frame, a circle member carrying a working implement, such as a blade and a plurality of guide shoes supporting the circle member under the drawbar structure. According to this invention, each of the guide shoes includes surfaces in engagement with both upper and lower surfaces of the circle member at all times. The guide shoes further include remotely controlled mechanical means for varying the frictional forces exerted by the guide shoes on the circle member whereby the circle member may be selectively held substantially immovable with respect to the drawbar structure by the guide shoes. Such remotely controlled mechanical means include a plurality of hydraulic cylinders each mounted on a different one of the guide shoes and according to the various embodiments of this invention, such hydraulic cylinders may be actuated either to increase or decrease the frictional force exerted by the guide shoes on the circle member.

Thus, it is an object of this invention to provide a motor grader including improved guide shoes for supporting a circle-mounted working implement on the drawbar structure thereof.

It is another object of this invention to provide a motor grader including improved guide shoes for supporting a circle-mounted working implement on the drawbar thereof which guide shoes are adapted to selectively hold the circle member substantially immovable with respect to such guide shoes and drawbar structure in operation in order to reduce wear of the guide shoes and circle member.

BRIEF DESCRIPTION OF THE DRAWINGS

The foregoing and other objects and features of this invention will be more fully understood from a reading of the following description of preferred embodiments thereof in conjunction with the attached drawing wherein.

DETAILED DESCRIPTION OF PREFERRED EMBODIMENTS

Figure 1:
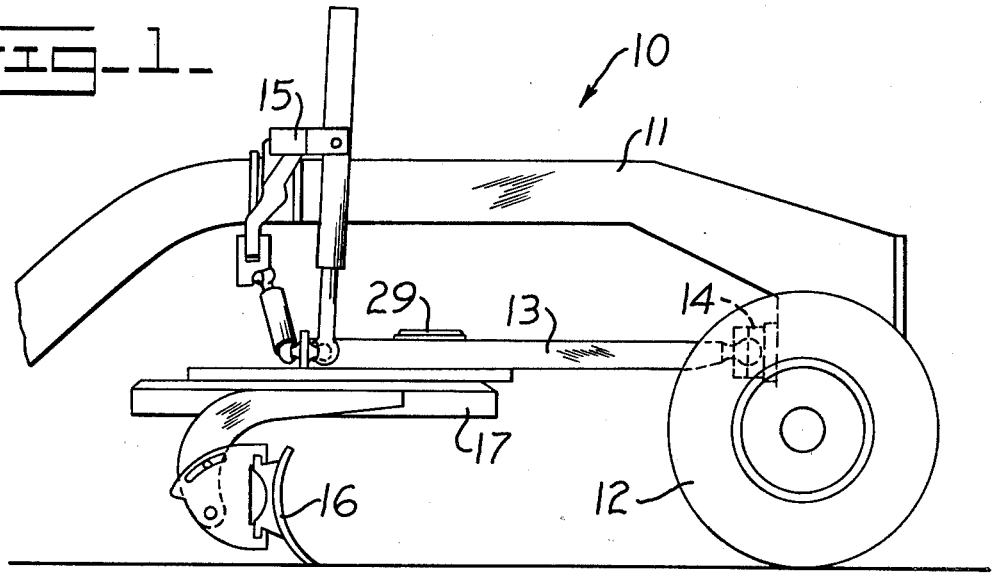
FIG. 1 is a fragmentary side view in elevation of the front end portion of a motor grader in accordance with the teaching of this invention.

The front end portion 10 of a motor grader to which this invention is applicable is depicted in FIG. 1. Such a motor grader comprises an elongated arched frame 11 supported at the front end by a pair of steerable wheels 12 and at the rear end (not shown) by one or more pairs of fixed driving wheels. The rear end portion of the motor grader also includes an appropriate engine unit mounted on the frame over the driving wheels which supplies the motive power for the motor grader as well as the power for operating the various control systems thereof.

An elongated drawbar structure 13 is mounted under the arched portion of the frame 11 with one end connected to the forward end of the frame 11 by means of a universal joint 14 (shown in phantom). The other end of the drawbar structure 13 is mounted on the arched portion of the frame 11 by appropriate hydraulic control links 15 adapted to enable the drawbar structure 13 to be pivoted about the universal joint at the other end thereof with respect to the frame 11.

A working implement such as an elongated blade 16 is mounted on a circle member 17 which is in turn mounted for rotary movement about is axis on the end of the drawbar structure 13 remote from the universal joint 14 by which such drawbar structure is attached to the frame 11. According to this invention the mounting of the circle member on the drawbar structure is provided by the improved guide shoes described in detail below, which enable an operator at a remote location to selectively fix the circle member 17 rigidly with respect to the drawbar structure 13 or allow the circle member 17 to be rotated about its axis with respect to the drawbar structure 13.

Figure 2:
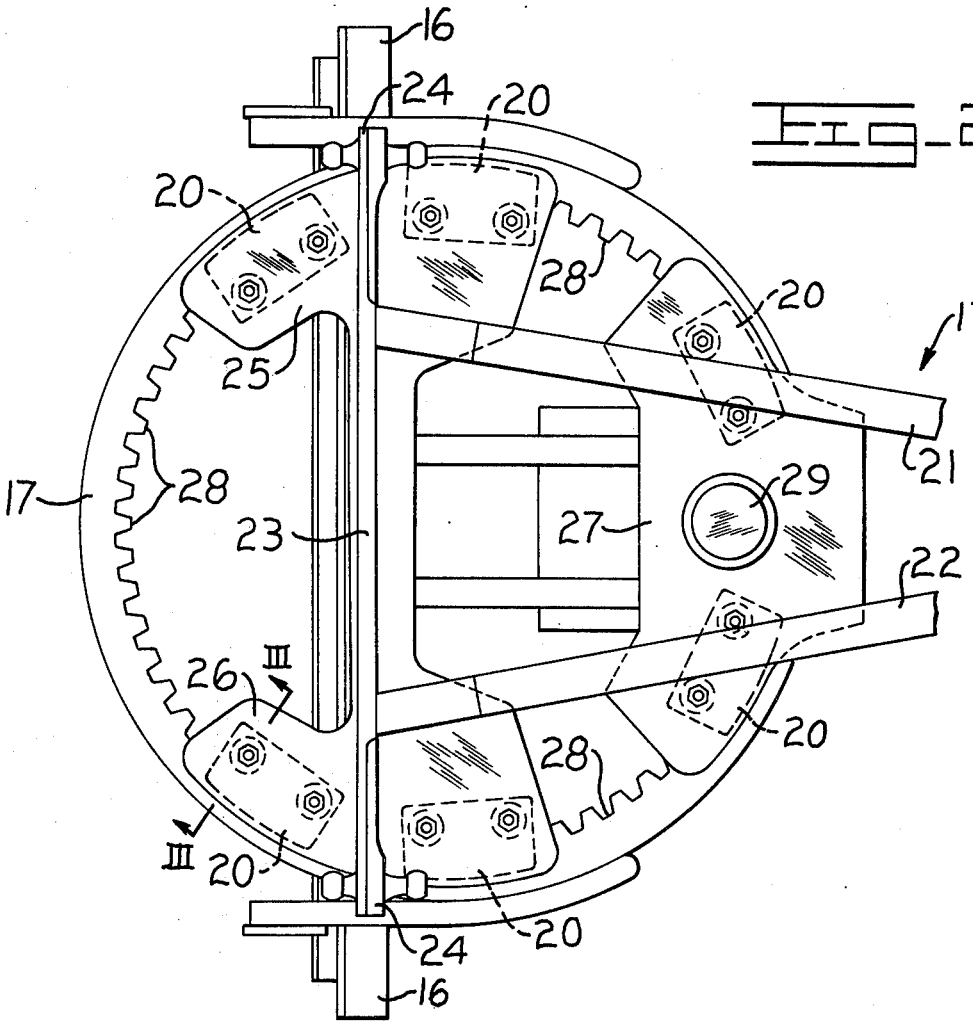
FIG. 2 is a top plan view of the drawbar structure of the motor grader of FIG. 1 showing a circle-mounted blade supported thereon by means of guide shoes in accordance with the teaching of this invention.

FIG. 2 is an enlarged top view of the end of the drawbar structure 13 remote from the universal joint 14 by which it is attached to the frame 11. The circle member 17 carrying an elongated blade 16 is shown mounted under such end of the drawbar structure 13 by guide shoes according to this invention.

Thus, it will be seen that the drawbar structure 13 is basically a triangle comprising a pair of elongated girders 21 and 22 which form the sides of the triangle and converge to an apex at the universal joint 14 by which the drawbar structure 13 is attached to the frame 11. The base of the triangle is formed by a third girder 23 having projecting ends 24 which are provided with ball joint connecting means for attachment of the hydraulic control links 15 by which the free end of the drawbar structure 13 is mounted on the arched portion of the frame 11.

The circle member 17 is rotatably mounted under the drawbar structure 13 by means of three spaced guide shoes structures comprising upper support plates 25, 26 and 27 which are rigidly mounted on the drawbar structure 13 and carry the lower guide plates 20 (shown in phantom in FIG. 2). As shown in FIG. 2, the support plates 25 and 26 are mounted at opposite ends of the girder 23 which forms the base of the triangular drawbar structure 13 and the third shoe structure 27 is mounted between the girders 21 and 22 which form the sides of the triangular drawbar structure 13. By such three-point support of the circle member 17, the axis of the circle member 17 is fixed with respect to the drawbar structure 13. Thus, the circle structure 17 may be raised and lowered with respect to the arched portion of the frame 11, or the axis thereof may be tilted with respect to the frame 11, by means of the hydraulic control links 15 attached to the ball joint connection means at the end 24 of the girder 23 of the drawbar structure 13.

As shown in FIG. 2, the inner periphery of the circle member 17 is provided with gear teeth 28 adapted to engage an appropriate drive means 29 shown in FIG. 2 as being mounted on the support plate 27. Such drive means 29 may comprise a worm or spur gear driven by an appropriate electrical or hydraulic motor, for example, and could be mounted elsewhere on the drawbar structure 13 for engagement with the gear teeth 28.

Thus, it will be seen that the working implement or blade 16 carried by the circle member 17 may be raised and lowered or tilted with respect to the surface upon which the motor grader is traveling by means of the control links 15. In addition, the angle of the working implement or blade 16 with respect to the direction of travel of the motor grader may be changed through rotation of the circle member 17 by engagement of the drive means 29 with the gear teeth 28 at the inner periphery of the circle member 17.

In operation, the vertical position of the working implement or blade 16 and the tilt thereof with respect to the surface to be graded is set by adjustment of the control links 15. As the motor grader is driven along such surface, the working implement or blades 16 will scrape up the desired upper portion of such surface. The material scraped up will be collected by the blade 16 which will tend to deposit such material in windows at one or both ends thereof, depending on the angle of such blade 16 with respect to the direction of the motor grader.

It will be understood that the purpose of such operation is to smooth an uneven surface or change the grade of such surface. In any event, the amount of material scraped up by the blade 16 at various points in the travel of the motor grader along such surface will vary. At times the amount of such material will become large enough to cause such material to be forced upwardly against the underside of the circle member 17, tending to pass over the upper edge of the blade 16 and be redeposited therebehind. This undesirable result may be avoided by changing the angle of the blade 16 with respect to the direction of travel of the motor grader to cause the material to be more rapidly discharged into a window at one end of the blade 16.

Thus, during a particular pass of the motor grader 10 over a surface to be graded, the angle of the blade 16 with respect to the direction of travel of the motor grader may be changed although the vertical positioning and tilt of the blade 16 with respect to such surface must remain constant. Modern road graders include automatic blade control (A. B. C.) devices which function to maintain the vertical positioning and tilt of the blade 16 with respect to the surface constant within a tolerance of ⅛ inch (4 mm). However, the necessary rotation of the circle member 17 with respect to the drawbar structure 13 to change the angle of the blade 16 with respect to the direction of travel of the motor grader has introduced a serious problem with respect to maintaining the graded surface within the tolerance which automatic blade control devices are capable to producing and which is in fact required by the specifications for many modern road surfaces.

It will be understood that the mounting of the circle member 17 on the drawbar structure 13 by means of the guide shoes must provide for the adjustment of the angle of the blade 16 with respect to the direction of motion of the motor grader through rotation of the circle member about the axis by the drive means 29. Thus, the guide shoes cannot rigidly mount the circle member 17 with respect to the drawbar structure 13. In addition, rotational movement of the circle member 17 against the guide shoes will produce wearing of the mating surfaces there of.

Such wear is complicated by the fact that the mating surfaces involved are exposed to the entry of abrasive materials from the surface being graded such as particles of dirt and fine gravel, etc. Such abrasive materials will tend to be captured in the lubricant present between the mating surfaces producing, in effect, a grinding compound which will accelerate the wearing process.

It will be understood that the working implement or blade 16 will be subject to extreme vibrations in operation as it scrapes along the surface to be graded. Such vibrations, as well as the rotary movement involved in changing the angle of the blade with respect to the direction of motion of the motor grader along the surface will power the grinding process, accelerating the wear of the mating surfaces. The wearing of the mating surfaces will introduce lost motion into the mounting of the circle member 17 on the drawbar structure 13, permitting undesirable vertical movement between the blade and the surface being graded.

According to this invention, the guide shoes are designed to automatically compensate for any lost motion that may be introduced by the wearing of the mating surfaces. In addition, the guide shoes, according to this invention, are designed to reduce the amount of such wearing of the mating surfaces by enabling the circle member 17 to be selectively rigidly fixed with respect to the drawbar structure 13 under the remote control of the operator of the motor grader. By rigidly fixing the circle member 17 with respect to the drawbar structure at all times during operation except when it is desired to rotate the circle member 17, the wearing of the mating surfaces powered by vibrations in operation, will be reduced. Furthermore, since the guide shoes automatically compensate for lost motion due to wearing, the release of the circle member 17 to allow adjustment of the angle of the blade 16 with respect to the direction of motion of the motor grader will not result in any change in the vertical positioning of the blade with respect to the working surface. Finally, the amount of abrasive material present between the mating surfaces will be reduced by the fact that the guide shoes automatically compensate for lost motion due to wearing, thus making it difficult for such abrasive materials to enter between the mating surfaces.

Figure 3:
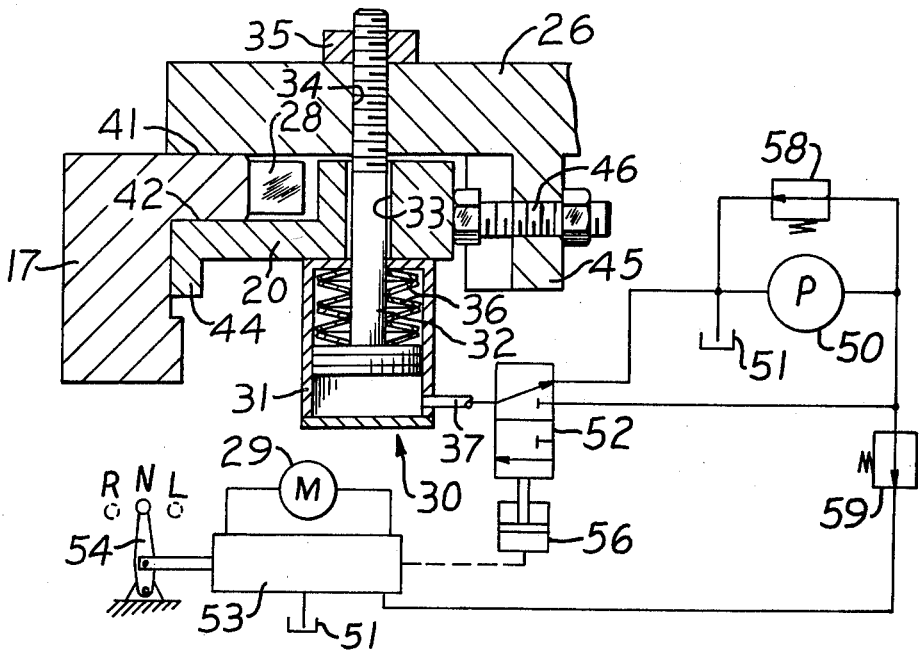
FIG. 3 is a cross-sectional view of a guide shoe according to one embodiment of the teaching of this invention and includes a schematic representation of a hydraulic circuit for remote control of the mechanical means included in such guide shoe for varying the frictional forces exerted by the guide shoe on the circle member.

Referring to FIG. 3, an enlarged fragmentary cross-sectional view of one embodiment of this invention taken along line III-III of FIG. 2 is shown. As shown in FIG. 3, each of the lower guide plates 20 is mounted on an upper support plate 26 (25, 27) with a portion of the circle member 17 sandwiched therebetween by a novel mechanical means 30, according to the teaching of this invention.

The novel mechanical means 30, according to the embodiment of this invention shown in FIG. 3, comprises a hydraulic cylinder 31 positioned so that the rod 32 thereof projects through aligned apertures 33 and 34 in the guide plate 20 and support plate 26, respectively. The free end of the rod 32 is threaded to receive a nut 35 and the rod end of the cylinder 31 is provided with belleville springs 36 acting to retract the rod 32. The cylinder head end of the cylinder 31 is provided with an inlet 37 for pressurized fluid in order to overcome the force of the belleville springs 36.

The support plate 26 is provided with a lower surface and the circle member 17 is provided with an upper surface which surfaces mate with each other along a first plane 41 transverse to the rod 32 of the cylinder 31. Similarly, the circle member 17 is provided with a lower surface and the guide plate 20 is provided with an upper surface which surfaces mate with each other along a second plane 42 transverse to the rod 32 of the cylinder 31. Thus, it will be seen that the circle member 17 will be compressively held by the forces exerted on the mating surfaces at the transverse planes 41 and 42 by the action of the belleville springs 36 in the absence of pressurized fluid at the inlet 37.

It will be understood that the relative dimensions and configuration of the guide plate 20, support plate 26 and circle member 17 are selected so that there will be an appropriate clearance between the guide plate 20 and support plate 26 when the circle member 17 is gripped therebetween through the action of the mechanical means 30. The guide plate 20 may be provided with an appropriate outer peripheral flange 44 engaging the inner periphery of the circle member 17 and the support plate 26 may be provided with a downwardly extending flange 45 carrying an adjustment bolt 46 with engages an inner periphery of the guide plate 20 in order to enable proper positioning of the circle member 17 with respect to the drawbar structure 13 and prevent cocking of the guide plate 20 with respect to the support plate 26.

It will be understood that upon application of pressurized fluid to the cylinder head end of the cylinder 31 through the inlet 37 the belleville springs 36 will be compressed against the rod end of the cylinder 31 and the compressive force exerted by the belleville spring 36 on the mating surfaces at the planes 41 and 42 by the rod 32 of the cylinder 31 will be relieved. In operation, the nut 35 on the threaded end of the rod 32 would be adjusted so that the compressive force exerted at the planes 41 and 42 would be sufficient to hold the circle member 17 rigid with respect to the support plate 26 and drawbar structure 13. As shown in FIG. 2 of the drawing, two or more of the mechanical means 30 will be associated with each of the guide plates 20 of the guide shoe structure and two or more guide shoes 20 will be associated with each of the support plates 25, 26 and 27 of the guide shoe structure. Thus, the total amount of force that will be exerted on the circle member 17 by the guide shoe structure may be made sufficient to avoid any movement including vibrational movement of the circle member 17 with respect to the drawbar structure 13.

When it is desired to rotate the circle member 17 about its axis with respect to the structure, pressurized fluid will be applied to the cylinder head end of each of the cylinders 31 of the mechanical means 30. The pressure of such pressurized fluid should be just sufficient to relieve the compressive force exerted at the planes 41 and 42 without allowing axial movement of the circle member 17. It will be understood that the drive means 29 will be able to overcome a certain amount of frictional force between the mating surfaces at the planes 41 and 42 and that the presence of a certain amount of compressive force between such mating surfaces will tend to prevent the entry of abrasive materials therebetween.

It is to be expected that a certain amount of wear of the mating surfaces at the planes 41 and 42 will occur. However, such wear will not result in lost motion in the guide shoe structure since lost motion will be compensated by the action of the belleville springs 36. Furthermore, the amount of such wear will be reduced due to the fact that the amount of abrasive materials which can enter between such surfaces and the amount of relative movement of such mating surfaces due to vibrational forces will be reduced through the action of the belleville springs 36.

As shown schematically in FIG. 3, appropriate control means may be provided to actuate the mechanical means 30 whenever the drive means for rotating the circle member 17 is actuated. Thus, a hydraulic pump 50, which may be driven by the engine unit of the motor grader provides hydraulic fluid under pressure from a reservoir 51 both to a two-way control valve 52 which may be connected in parallel to all of the mechanical means 30 and to a three-way control valve 53 connected to the drive means 29 by means of which the circle member 17 is rotated about its axis. An appropriate manually operated control lever 54 is mechanically connected to the slide member of the control valve 53 so that movement of the control lever 54 in one direction will actuate the drive means to rotate the circle member 17 in one direction about its axis whereas movement of the control lever 54 in the opposite direction will actuate the drive means 29 to rotate the circle member 17 in the opposite direction about its axis. The control valve 52 may be slaved to the control valve 53 by an appropriate means so that whenever the slide of the valve member 53 is moved in either direction the valve member 52 will be actuated to apply pressurized fluid to the inlet 37 of the cylinder 31.

As shown in FIG. 3, the control lever 54 is in its neutral position, thus causing the slide of the control valve 53 to be centrally located and allowing the control valve 52 to remain in its normal position in which the inlet 37 of the cylinder 31 is isolated from the pressurized fluid provided by the pump 50. Thus, the belleville springs 36 will exert compressive force on the mating surfaces at the transverse planes 41 and 42 and the circle member 17 will be held rigidly with respect to the drawbar structure 13. As indicated schematically in FIG. 3, whenever the control lever 54 is moved in either direction, hydraulic fluid will be applied to a slave cylinder 56 connected to the slide of the control valve 52 to move it into its opposite position thereby applying pressurized fluid through the inlet 37 to the cylinder head end of the cylinder 31 and thus releasing the circle member 17 for rotation by the drive means 29.

It will be understood that any appropriate means may be used for slaving the two-way control valve 52 to the three-way control valve 53 for operation as described above. For example, an electromagnetic control system could be substituted for the hydraulic control system including slave cylinder 56.

It will also be understood that it may be desirable to include appropriate pressure limiting and pressure release valves in the hydraulic system in order to provide fluid at the appropriate pressures for the operation of the system. Thus, a pressure relief valve 58 may be connected across the pump 50 in order to limit the maximum fluid pressure in the system and a pressure limiting valve may be interposed between the inputs to the control valves 52 and 53 in order to provide a minimum high pressure for operation of the cylinder 31 which will not be affected by the operation of the drive means 29.

Figure 4:
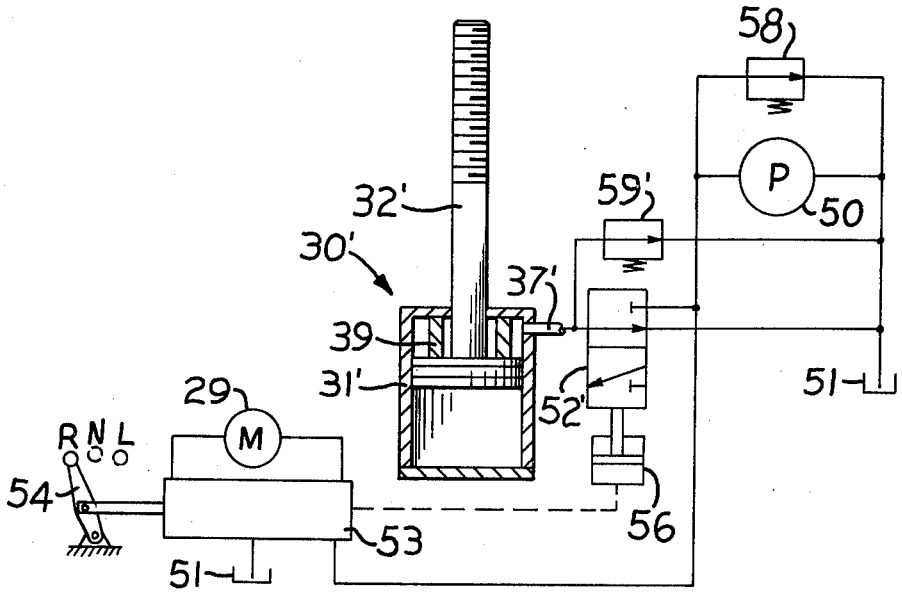
FIG. 4 is a cross-sectional view of an alternate mechanical means which would be substituted for the mechanical means of the guide shoe of FIG. 3 in another embodiment of this invention together with a schematic representation of a hydraulic circuit for remote control of such alternate mechanical means.

Referring to FIG. 4, an alternate embodiment 30′ of the mechanical means included in the guide shoes according to the teaching of this invention is shown. According to this embodiment of the invention, a hydraulic cylinders 31′ having a rod 32′ which is threaded at its free end, is used to mount the guide plates 20 on the support plates 26 (25, 27) in the same way as described hereinabove in connection with FIG. 3.

However, the hydraulic cylinder 31′ is provided with a spacer member 39 in the rod end thereof rather than the belleville springs as described in connection with FIG. 3. In addition, the high pressure fluid inlet 37′ is provided in the rod end of the cylinder 31′ rather than the head end thereof.

Thus, it will be seen that according to the embodiment of the invention shown in FIG. 4, the hydraulic cylinder 31′ is pressurized in order to increase the force exerted on the mating surfaces at the transverse planes 41 and 42 to thereby fix the circle member 17 rigidly with respect to the drawbar structure 13. When it is desired to rotate the circle member 17 with respect to the drawbar structure 13, the pressurized fluid in the cylinder 31′ is released to decrease the frictional forces at the transverse planes 41, 42.

A schematic representation of the hydraulic circuitry for operating this embodiment of the invention is shown in FIG. 4 wherein the same reference numerals have been used to identify elements corresponding to those of FIG. 3. Thus the hydraulic pump 50, reservoir 51, three-way valve 53, control lever 54, slave cylinder 56 and pressure limiting valve 58 are all substantially identical to those shown in FIG. 3. The two-way valve 52′ is adapted to operate in the reverse mode with respect to the two-way valve 52 of FIG. 3 and in FIG. 4 the system is shown in the condition to release the circle member 17 for rotation, whereas in FIG. 3, the system is shown in condition for fixing the circle member 17 with respect to the drawbar structure. It will be understood that the hydraulic cylinder 31′ of FIG. 4 will be subjected to the maximum pressure of the system at all times except when the circle member 17 is being rotated with respect to the drawbar structure 13. Thus, in FIG. 4, a pressure relief valve 59′ is provided in order to avoid application of an excessive constant pressure to the cylinder 31′.

It will be understood that a double-acting hydraulic cylinder could be substituted for the cylinder 31′ and the hydraulic circuitry associated therewith adapted to drive the cylinder in both directions. Such modifications would provide a positive release action similar to that provided by the embodiment of this invention shown in FIG. 3.

It will also be understood that the cylinder 31, 31′ of the mechanical means according to this invention could be rigidly fixed to the guide plates 20 and that the free end of the rod 32, 32′ thereof could be rigidly fixed to the support plates 25, 26 and 27 by engagement with an appropriate threaded aperture or other appropriate means in order to enhance the positive release action mentioned above as being provided by the embodiment of this invention shown in FIG. 3.

It will be understood that each of the plurality of guide plates 20 includes at least two separate units of the mechanical means 30, 30′ described hereinabove. All of such units may be hydraulically interconnected in parallel to the output of a single two-way valve 52, 52′ for equalized simultaneous operation.

It should be emphasized that the embodiments of this invention as specifically described hereinabove involve substantially no physical displacement of the guide plates 20 with respect to the support plates 25, 26 and 27 in operation. Instead, the frictional force present between the mating surfaces at the transverse planes 41 and 42 is changed without any substantial change in the physical location of such mating surfaces. Thus, operation of embodiments of this invention will not result in change in the vertical height of a working implement such as the blade 16 carried by the circle member 17. Furthermore, the intimate relationship between the mating surfaces at the transverse planes 41 and 42 will tend to inhibit the entry of abrasive materials therebetween. The presence of substantial frictional forces between the mating surfaces at the transverse planes 41 and 42 at all times during operation except when the circle member 17 is actually being rotated about its axis will minimize vibrational movements therebetween and the wear resulting therefrom. Any wearing of such surfaces which does occur will be automatically compensated by the mechanical means 30 to thereby eliminate the possibility of lost motion in the operation of the system.

It would, of course, be possible to make various modifications of the structure specifically described herein in other embodiments of this invention. For example, it would be possible to modify the guide plates 20 to provide an appropriate cocking or wedging action in operation in order to increase the frictional forces exerted on the circle member 17 without departing from the teaching of this invention. It is believed that this and the other modifications of the specific structures disclosed herein will be obvious to those skilled in the art.

What is claimed is:

1. A motor grader including a main frame mounted on wheels, a drawbar structure attached to said main frame, a circle member carrying a working implement and a plurality of guide shoes supporting said circle member under said drawbar structure; each of said guide shoes including generally vertically aligned surfaces in face to face mating engagement at all times with both upper and lower surfaces respectively of said circle member and each of said plurality of guide shoes including remotely controlled mechanical means for varying the frictional forces exerted by said guide shoes on said circle member without substantial change in the relative physical locations of said circle member and guide shoe surfaces, said mechanical means selectively exerting sufficient force on said guide shoes such that said circle member may be selectively held substantially immovable with respect to said drawbar structure by said guide shoes.

2. A motor grader as claimed in claim 1 wherein said remotely controlled mechanical means of such plurality of guide shoes includes a hydraulic cylinder.

3. A motor grader as claimed in claim 2 wherein said remotely controlled mechanical means of each of said plurality of guide shoes includes spring means exerting a given frictional force on said circle member and said hydraulic cylinder is adapted to be actuated to decrease said given frictional force.

4. A motor grader as claimed in claim 2 wherein said remotely controlled mechanical means of at least one of said plurality of guide shoes includes a plurality of hydraulic cylinders adapted to be hydraulically actuated simultaneously to increase the frictional force exerted by said guide shoe on said circle member.

5. A motor grader as claimed in claim 2 wherein each of said plurality of guide shoes comprises an apertured support plate and an apertured guide plate, said support plate being rigidly mounted on said drawbar structure and the rod of said hydraulic cylinder passing through the apertures of both said guide plate and said support plate with said guide plate supported on said hydraulic cylinder and the free end of said rod restrained on the opposite side of said support plate from said guide plate.

6. A motor grader as claimed in claim 5 wherein said hydraulic cylinder includes belleville spring means in the rod end thereof and a coupling for pressurized fluid in the cylinder head end thereof.

7. A motor grader as claimed in claim 5 wherein said hydraulic cylinder includes a spacer means in the rod end thereof to prevent bottoming of said cylinder and a coupling for pressurized fluid in said rod end thereof.

8. A motor grader as claimed in claim 5 wherein said hydraulic cylinder is rigidly fixed to said guide plate and said rod of said hydraulic cylinder is rigidly fixed to said support plate.

9. A motor grader as claimed in claim 1 including driving means for rotating said circle member about its axis and common control means for said driving means and said remotely controlled mechanical means adapted to actuate said remotely controlled mechanical means to reduce said frictional forces exerted by said guide shoes on said circle member whenever said driving means is actuated.

10. A motor grader as claimed in claim 9 wherein said driving means is a hydraulic motor, said remotely controlled mechanical means includes a hydraulic cylinder and said common control means comprises an appropriate hydraulic circuit including a hydraulic pump for supplying pressurized fluid in said hydraulic circuit.

* * * * *